US005088963A

United States Patent [19]

Goldston

[11] Patent Number: 5,088,963

[45] Date of Patent: Feb. 18, 1992

[54] DOCUMENT PREPARATION KIT

[76] Inventor: Sidney Goldston, 60 NW. 3rd St., Miami, Fla. 33101

[21] Appl. No.: 687,221

[22] Filed: Apr. 18, 1991

[51] Int. Cl.[5] ..... B41L 1/20

[52] U.S. Cl. ..... 162/56; 462/75

[58] Field of Search ..... 462/56, 62, 63, 75; 283/61, 62, 117

[56] References Cited

U.S. PATENT DOCUMENTS

| | | | |
|---|---|---|---|
| 1,681,296 | 8/1928 | Lewis | 462/56 |
| 2,092,127 | 9/1937 | Lankton | 462/56 |
| 2,735,695 | 2/1956 | Bryngelson | 462/56 |
| 3,154,305 | 10/1964 | Pollard | 462/56 |

*Primary Examiner*—Timothy V. Eley

*Assistant Examiner*—Willmon Fridie, Jr.

*Attorney, Agent, or Firm*—Malloy, Downey & Malloy

[57] ABSTRACT

A kit for preparing a document including a cover sheet having advertising indicia on one side and instructional information on the opposite side and a bound packet of document forms of identical type interconnected to and independently detachable from a binding. The documet forms include a completed sample form, a practice form, and original document form and a carbon copy form. The completed sample document form and the practice form include reference numerals corresponding with a checklist in the informational material, wherein the original document and carbon copy are prepared and completed with reference to practice entries made on the practice form.

5 Claims, 1 Drawing Sheet

DOCUMENT PREPARATION KIT

BACKGROUND OF THE INVENTION

The present invention relates to a document preparation kit for preparation of a document such as, but not limited to, a bill of sale, a will, a mortgage, etc.

There are many transactions, sometimes relatively simple, that require a legal document or other type of documentation to be prepared in order to express the intentions of all parties involved in the transaction so as to protect each of their interests and avoid confusion at a later date. Often, the transaction or event is relatively simple in nature such as the sale of goods, claim of a lien, or a landlord/tenant agreement, wherein it is ordinarily not necessary or desirable to hire the services of an attorney. To accommodate these situations, there are numerous legal forms and other document forms in the related art which are specifically designed for a particular type of transaction or event. In order to complete these forms so as to create a legal document, it is necessary to fill in a number of blank spaces and areas with various information which is relevant to the transaction or event at hand. Because the entries made in these blank spaces can have legal consequences of considerable magnitude at a future date, it is extremely important that the proper information be entered in the appropriate areas by the person preparing the document. Most often, the person preparing the document is a non-lawyer and can be easily confused as to what information should be entered in the various blank spaces and areas on the form. In the past, attempts to provide instruction as to the various entries to be made and the proper preparation and completion of the forms have only led to further confusion making it even more difficult for the non-lawyer.

Accordingly, it is an object of the present invention to provide a document preparation kit which is specifically directed for use by the non-lawyer wherein preparation and completion of the document is extremely simple and non-confusing.

It is another object of the present invention to provide a document preparation kit having informational material including a checklist specifically directed to the completion of various entries to be made on a document form.

It is a further object of the present invention to provide a bound packet of document forms of an identical type including a completed sample form, a practice form, an original document form, and a carbon copy wherein sample entries on the sample form and practice entries on the practice form include reference numerals for each entry corresponding with identical numerals on a checklist, thereby specifically identifying each entry to the user.

With these and other objects and advantages of the present invention in mind, the document preparation kit of the present invention includes a bound packet of document forms of a particular type arranged in stacked, overlying relation and interconnected to a binding along a bottom edge. Each of the forms is individually detachable along a perforated seam adjacent the binding. A cover sheet is packaged along with the bound packet of forms and includes advertising indicia on an exposed surface so as to be readily visible when in the package. The cover sheet further includes information and instructional material on a reverse side including a checklist directed to the proper completion of the document. Alternatively, the instructional material could be printed on a separate sheet independently from the cover sheet and loosely inserted within the package. Included in the document forms there is a completed sample form with example entries printed on blank spaces on the form and a practice form for use in making entries in the various blank spaces of the form prior to preparing the final document. The completed sample form and practice form both include reference numerals at each of the blank spaces which correspond with matching numerals on the checklist so as to identify each individual entry to be made on the practice form. Also included in the bound packet of forms there is an original document which will be the final product and a carbon copy or duplicate document having a carbon sheet disposed therebetween so that entries made on the original form will be transferred onto the duplicate in the appropriate blank spaces. Once having completed the practice form, the original form can be completed by referring to the entries made on the practice form.

The invention accordingly comprises the features of construction, a combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in FIGS. 1-5, the present invention is directed to a document preparation kit, generally indicated as 10, for use in preparing various documents such as, but not limited to, a bill of sale, a will, a landlord/-tenant agreement, and the like. The document preparation kit 10 is specifically designed for use by any individual, including a non-lawyer having virtually no legal experience or knowledge of the law.

Figure 1:
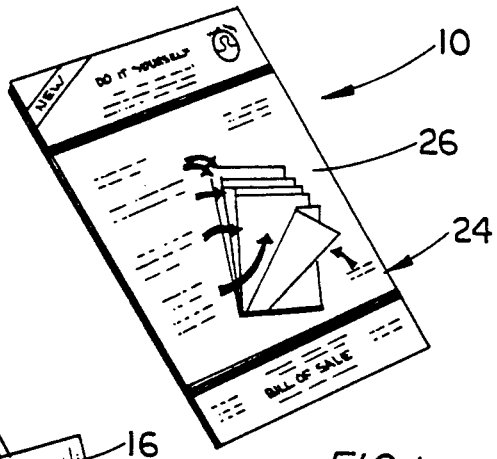
FIG. 1 is a perspective view of the form preparation kit of the present invention illustrating the packaged arrangement thereof.
Figure 2:
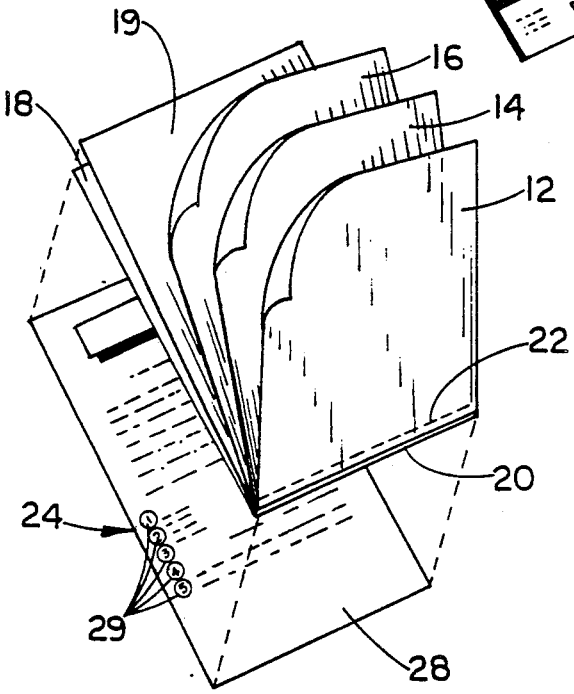
FIG. 2 is a partially exploded view shown in perspective illustrating the various elements of the form preparation kit of the present invention.

As seen in FIGS. 2-5, the document preparation kit 10 includes a plurality of document form sheets including a completed sample form 12, a draft copy form 14, an original document form 16, and a duplicate copy form 18 with a carbon sheet 19 disposed between the duplicate copy 18 and the original document form 16. The plurality of form sheets are oriented in a stacked, overlying relation and are all attached to a common binding 20 at a bottom edge thereof. Each of the form sheets are individually detachable along a perforated seam 22 extending along a bottom edge of the forms in close, spaced parallel relation to the binding 20. A separated cover sheet 24 is preferably placed on an under side of the bound plurality of form sheets so that an upper side 26 of the cover sheet 24, having advertising indicia thereon, is readily exposed when packaged, as best illustrated in FIG. 1. A reverse side 28 of the cover sheet 24 includes informational material as to how to properly complete the document form, including a numbered checklist having individually numbered steps for filling in various blank spaces on the document form.

Figure 3:
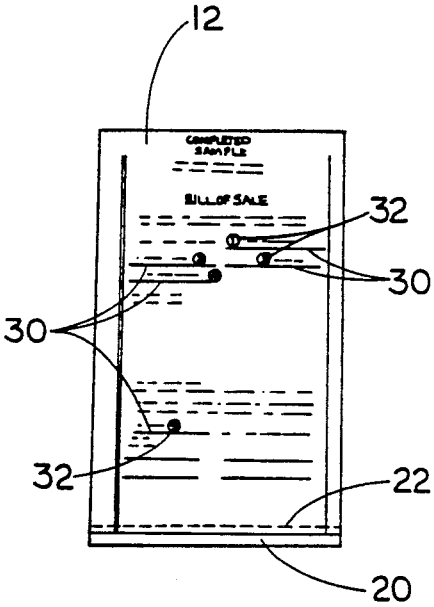
FIG. 3 is a top plan view of a completed sample form of the form preparation kit of the present invention.
Figure 4:
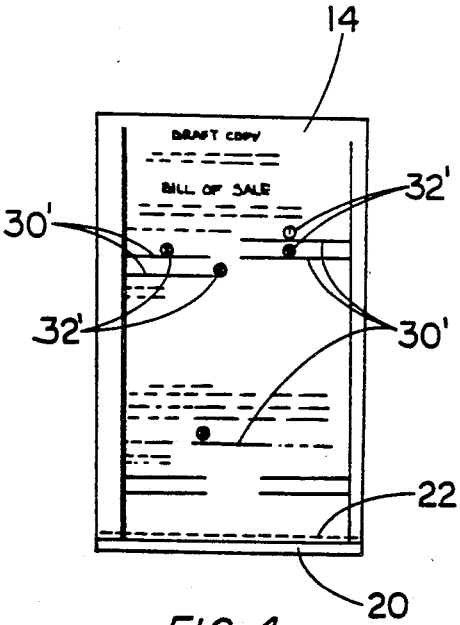
FIG. 4 is a top plan view of a draft copy form in the form preparation kit of the present invention.
Figure 5:
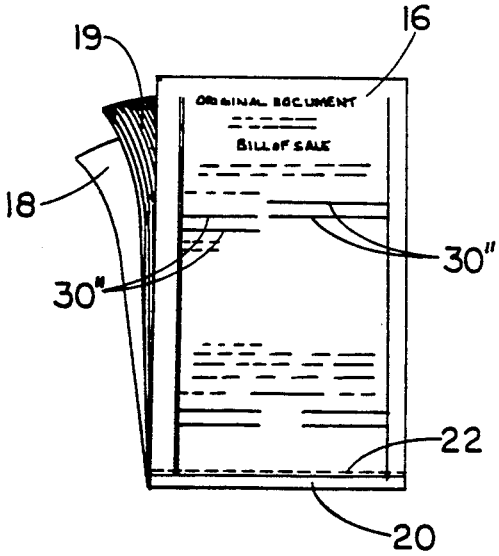
FIG. 5 is a top perspective view of an original docket form, carbon sheet, and duplicate copy form as used in the preferred embodiment of the present invention.

Each of the plurality of form sheets, 12, 14, 16, and 18, are of the same identical type whether it be a bill of sale, mortgage, will, etc. with the original document form 16 being the ultimate document to be prepared. The completed sample document form 12, as seen in FIG. 3, is the first form sheet in the stacked, bound array that includes a plurality of blank spaces 30 having reference numerals 32 at each one of the blank spaces 30, the reference numerals 32 corresponding with matching numerals 29 in the checklist on the reverse side 28 of the cover sheet 24. In each of the blank spaces 30 of the completed sample sheet, there is an example entry to assist the user in understanding the manner in which the form is to be completed. The example entries next to each of the reference numerals 32 are explained on the checklist next to each of the corresponding matching numerals 29. A draft copy form is provided to allow the user to practice preparing the document and includes a plurality of blank spaces 30′ which correspond with the blank spaces 30 on the identical form in the completed sample document form 12. Next to each of the blank spaces 30′ on the draft copy, there are reference numerals 32′ which correspond with the reference numerals 32 on the completed sample document form and the checklist numerals 29. By following the explanation next to each of the reference numerals 29 on the checklist, the user can simply fill in the appropriate information in each of the blank spaces 30′ on the draft copy sheet 14. Once having completed the draft copy, the user can then proceed to prepare the original document 16 which is identical in nature to the draft copy document form except that there are no reference numerals next to blank spaces 30″ on the original document. Entries are made in the blank spaces 30″ on the original document 16 by the user by referring to entries made in the blank spaces 30′ on the draft copy. In this manner, mistakes can be eliminated while preparing the original document 16, with any mistakes or corrections being made on the draft copy 14 prior to preparation of the original document 16. Underlying the original document, there is a duplicate copy 18 which is identical in nature to the original document 16 having the same blank spaces 30″ thereon. A carbon sheet 19 is disposed therebetween so that entries made in the blank spaces 30″ on the original document will be transferred through to the corresponding blank spaces on the duplicate form 18. Once having completed the original document 16, both the original document 16 and the duplicate document 18 can be removed from the binding 20 by tearing along the perforated seam 22, wherein each of the separate documents can be dispersed to the appropriate party.

The invention as described above is not to be limited except as set forth within the claims and within the doctrine of equivalents.

Now that the invention has been described, what is claimed is:

1. A document preparation kit, comprising:

a cover sheet including advertising indicia printed thereon, and further including instructional material thereon relating to the preparation and completion of the document, a plurality of bound document forms disposed in overlying, stacked relation and attached along a common binding, each of said plurality of forms being individually detachable from said binding along a perforated seam, said plurality of forms including a complete sample document having example entries printed in blank spaces thereon, said plurality of forms further including a practice form having blank spaces thereon, wherein practice entries are made thereon by a user in accordance with said instructional material on said cover sheet, said blank spaces on said practice form including reference numerals corresponding with matching numerals in said instructional material so as to identify each of said practice entries, and said plurality of forms further including an original document form disposed in overlying relation to a duplicate form with a carbon transfer sheet disposed therebetween, wherein final entries are made in blank spaces on said original document with reference to said practice entries on said practice form, said final entries being transferred onto said duplicate form in corresponding locations thereon, thereby completing preparation of the document.

2. A document preparation kit as in claim 1 wherein said cover sheet is separable from said plurality of document forms.

3. A document preparation kit as in claim 2 wherein said advertising indicia is printed on a front side of said cover sheet.

4. A document preparation kit as in claim 3 wherein said instructional material is printed on a rear side of said cover sheet.

5. A method of preparing a document comprising the steps of:

reading instructions including a checklist directed to the proper completion of the document, reviewing a completed sample document form having example entries printed in blank spaces thereon, matching reference numerals next to each of the blank spaces on the completed sample form with corresponding numerals on the checklist so as to identify and provide an explanation of each of the entries, entering relevant information in blank spaces on a practice form in accordance with said reference numerals and said corresponding numerals on said checklist, entering said relevant information in blank spaces on an original document form in accordance with said information entered in the blank spaces of said practice form, simultaneously transferring said pertinent information entered on said original document form through a carbon sheet onto a duplicate copy form, and removing each of said forms for independent use.

* * * * *